US005119539A

United States Patent [19]

Curry

[11] Patent Number: 5,119,539

[45] Date of Patent: Jun. 9, 1992

[54] LACE FASTENER

[76] Inventor: Larry E. Curry, 8113 44th St. W., Tacoma, Wash. 98466

[21] Appl. No.: 624,075

[22] Filed: Dec. 7, 1990

[51] Int. Cl.[5] ..... F16G 11/00

[52] U.S. Cl. ..... 24/712.1; 24/130; 24/712.9

[58] Field of Search ..... 24/712.1, 712.2, 712.5, 24/712.9, 713.2, 713.3, 713.4, 127, 128, 129 R, 129 A, 129 B

[56] References Cited

U.S. PATENT DOCUMENTS

| | | | |
|---|---|---|---|
| 479,509 | 7/1892 | Heaphy, Jr. | 24/129 A |
| 509,707 | 11/1893 | Vachon | 24/712.1 |
| 656,431 | 8/1900 | Stewart | 24/129 A |
| 757,820 | 4/1904 | Lykke | 24/130 |
| 958,168 | 5/1910 | Petersen | 24/129 A |
| 1,034,741 | 8/1912 | Smith | 24/129 R |
| 1,065,190 | 6/1913 | Tobin | 24/130 |
| 1,782,625 | 11/1930 | Neuberger | 24/129 R |
| 1,806,162 | 5/1931 | Hahn | 24/712.9 |
| 3,358,338 | 12/1967 | Clasen | 24/712.9 |
| 4,315,350 | 2/1982 | Looker et al. | 24/128 |

FOREIGN PATENT DOCUMENTS

| | | | |
|---|---|---|---|
| 0192804 | 11/1957 | Austria | 24/712.1 |

*Primary Examiner*—Victor N. Sakran
*Attorney, Agent, or Firm*—Christensen, O'Connor, Johnson & Kindness

[57] ABSTRACT

A fastener (10) is disclosed for simply, quickly, and effectively securing the ends (36) and (38) of a lace (40) with respect to an article of clothing, such as a shoe (42). The fastener includes a body (12) having first and second surfaces (14) and (16) and a perimeter (18). A pair of slotted openings (20) and (22) and recesses (24) and (26) are further provided in the body to engage the lace ends as follows. The ends of the laces are threaded through the openings and tied. The fastener is then moved along the lace ends to position adjacent the shoe. The fastener is then flipped over, drawing the ends of the lace into the slots and securely fixing the laces relative to the shoe.

4 Claims, 3 Drawing Sheets

Fig. 1.
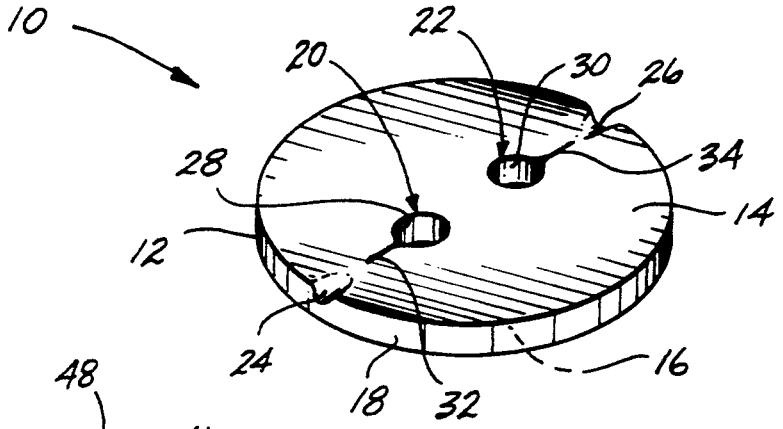
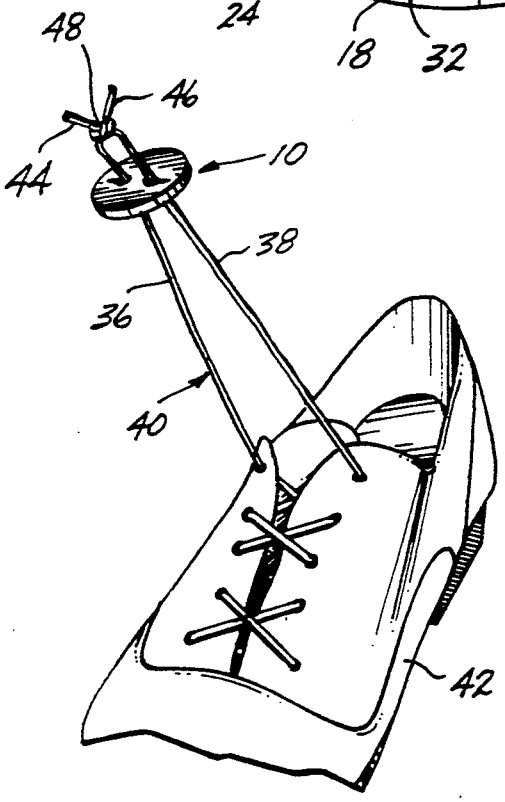
Fig. 2.
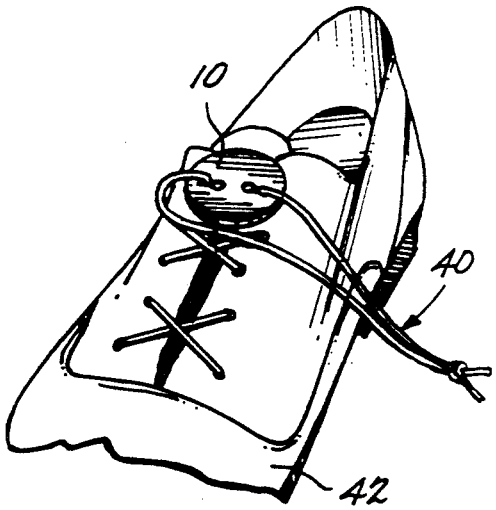
Fig. 3.
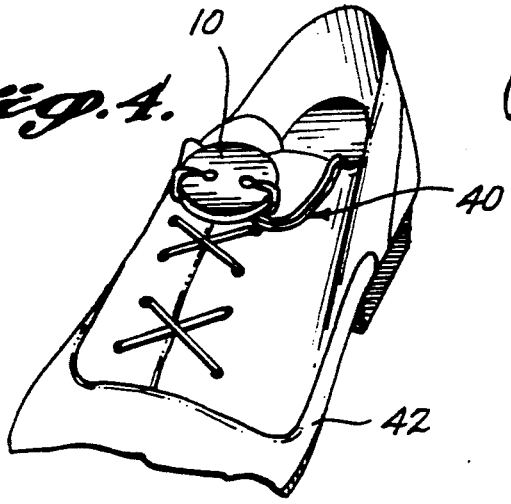
Fig. 4.

LACE FASTENER

FIELD OF THE INVENTION

This invention relates generally to fasteners and, more particularly, to fasteners for use with laces.

BACKGROUND OF THE INVENTION

A wide variety of fasteners has been developed for use with clothing. For example, snaps, zippers, buckles, and straps are often used to secure footwear, trousers, and jackets. One of the simplest and most common forms of fasteners is the lace.

In that regard, laces are widely used to secure footwear to people's feet. By way of illustration, a single lace is typically used to retain a shoe on a wearer's foot. The shoe is initially "laced" by threading the aglets or tips of the lace through eyelets provided in the shoe's flaps in an alternating, crossed pattern adjacent the shoe's tongue. The portions of the lace extending between the top flap eyelet and the lace aglets, referred to herein as the lace "ends," should be roughly equal in length.

Once the shoe is laced, the lace is usually tied in the following manner. First, tension is applied to the ends of the lace, pulling the flaps of the shoe together and cinching the shoe's tongue securely against the wearer's foot. The ends of the lace are then conventionally tied together to prevent the flaps from spreading and keep the shoe securely on the wearer's foot. Generally, a "butterfly" knot is used to secure the ends of the lace together. This knot is often employed because it is relatively secure, yet relatively easy to tie and untie.

As will be appreciated, the use of a lace to secure a shoe is just one application for laces in clothing. In that regard, a lace is often used as a drawstring at the waist of a jacket or a pair of pants, or the opening of a hood. This use of a lace, though somewhat simpler than that described above, still relies upon the fastening of the ends of the lace together to hold an article of clothing in place.

Although conventional lace fasteners are simple, inexpensive, and relatively effective, they do present some problems. For example, small children are often unable to properly tie a butterfly knot or tie such a knot with sufficient force to prevent it from quickly untying. The same is true of an adult that has only one hand free, or available, to tie the ends of the laces. In either case, the laces included on many articles of clothing may provide unsuitable fasteners.

Given the widespread use of laces for fasteners, it would be desirable to provide a simple, inexpensive device or technique that would allow the ends of a lace to be easily and securely tied together.

SUMMARY OF THE INVENTION

In accordance with this invention, a lace fastener is provided for securing the ends of a lace. The fastener includes a main body and a lace-engaging element, coupled to the main body, to slidably engage the ends of the lace and secure the ends together.

In accordance with a more particular aspect of the invention, the lace fastener includes a body having first and second surfaces and a perimeter. The body includes a pair of openings, provided with slots, that extend between the first and second surfaces of the body. These slots are directed toward the perimeter of the body. The perimeter of the body is further provided with a pair of recesses, spaced roughly 180 degrees apart and positioned along the same axis as the pair of openings.

In accordance with another aspect of this invention, a method of tying the ends of a lace attached to an article of clothing is disclosed. The method includes the step of engaging each end of the lace with a slot provided in a fastening device. Next, the fastening device is moved adjacent the article of clothing. Finally, the fastening device is rotated to produce a secure frictional engagement between the ends of the lace, the fastening device, and the article of clothing.

BRIEF DESCRIPTION OF THE DRAWINGS

The invention will presently be described in greater detail, by way of example, with reference to the accompanying drawings, wherein:

FIG. 1 is an illustration of a lace fastener constructed in accordance with this invention;

FIGS. 2, 3, and 4 illustrate the sequence of steps used to fasten the ends of a lace, threaded through the flap eyelets of a shoe, with the lace fastener of FIG. 1;

DETAILED DESCRIPTION OF THE PREFERRED EMBODIMENT

Figure 5:
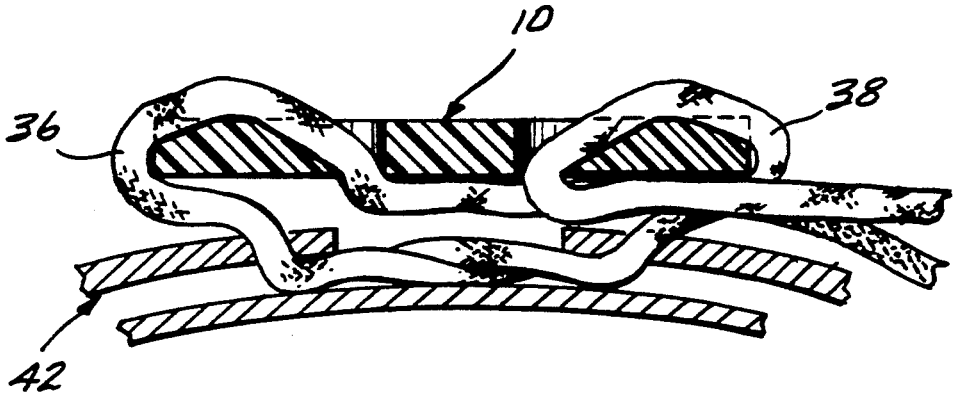
FIG. 5 illustrates in greater detail the manner in which the lace fastener secures the ends of the lace when positioned as shown in FIG. 4.
Figure 6:
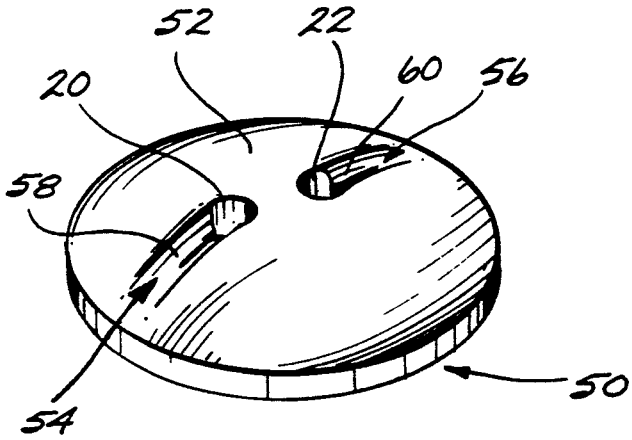
FIG. 6 is an illustration of an alternative embodiment of the lace fastener of FIG. 1.

Referring now to FIG. 1, a lace fastener 10 constructed in accordance with this invention is shown. As will be described in greater detail below, the lace fastener is an extremely simple and inexpensive device that allows the ends of a lace to be easily and conveniently secured adjacent an article of clothing. More particularly, the fastener is constructed to allow the ends of the lace to be secured adjacent the article of clothing more simply than with conventional "tying" methods.

Addressing the construction of the lace fastener in greater detail, the first embodiment 10 of the lace fastener, shown in FIG. 1, includes a generally cylindrical, disc-shaped body 12. The body 12 defines a first surface 14 and a substantially parallel second surface 16. The first and second surfaces 14 and 16 are joined by a perimeter 18.

The body 12 is also provided with a pair of slotted openings 20 and 22 and recesses 24 and 26, positioned along a common access defined by the diameter of the body 12. In that regard, the spaced-apart openings 20 and 22 are located symmetrically about the center of body 12. The openings 20 and 22 are defined by roughly cylindrical passages 28 and 30 that extend into roughly V-shaped grooves or slots 32 and 34, directed toward the perimeter 18 of the body 12.

The passages 28 and 30 are constructed to loosely receive the ends of a lace. Slots 32 and 34 are, however, constructed to grasp, or frictionally engage, the ends of the lace. In that regard, slots 32 and 34 may taper in one or two directions. Specifically, the width of slots 32 and 34 may decrease with distance from the passages 28 and 30. The depth of slots 32 and 34 may also decrease with distance from the passages 28 and 30. Alternatively, slots 32 and 34 may simply be provided as slits of substantially uniform width and depth.

The recesses 24 and 26 are provided as relatively smoothly contoured channels extending at an acute angle through the first surface 14 and perimeter 18 of body 12. Recesses 24 and 26 are intended to receive a portion of the ends of the lace extending between the shoe and the slotted openings 20 and 22. As a result, the positions of the ends of the lace with respect to the perimeter 18 can be largely maintained, ensuring the continued secure fastening of the lace as described in greater detail below.

In the preferred arrangement, the body 12 of the lace fastener 10 is roughly 3.2 centimeters in diameter and 0.32 centimeter thick. Passages 28 and 30 of slotted openings 20 and 22 are roughly 0.32 centimeter in diameter and are spaced apart by a distance of 0.95 centimeter. Slots 32 and 35 extend from the passages 28 and 30 by a distance of roughly 0.32 to 0.48 centimeter. Recesses 24 and 26 extend 0.32 centimeter into the first surface 14 from perimeter 18, roughly halfway between first surface 14 and second surface 16 at perimeter 18, and are roughly 0.64 centimeter wide at the intersection of first surface 14 and perimeter 18.

The lace fastener 10 can be made of any of a variety of materials. In that regard, the fastener 10 is preferably relatively flexible. In addition, the fastener 10 should be tear-resistant and resistant to flexural failure. Further, it would be desirable for the fastener 10 to be made of a material having a relatively high coefficient of friction. In the preferred arrangement, the fastener 10 is made of plastic.

Having described the basic construction of the fastener 10 shown in FIG. 1, its use to secure the ends 36 and 38 of a lace 40 with respect to a shoe 42 will now be described in connection with FIGS. 2 through 4. By way of preparation, the lace 40 is threaded in alternating fashion through eyelets in the flaps of shoe 42 in a conventional manner as shown in FIG. 2. The aglets 44 and 46 of the lace 40 are then passed through the slotted openings 20 and 22 of the fastener body 12 and the distal portions of the ends 36 and 38 of the lace 40 tied in a knot 48 as shown.

At this time, the lace fastener 10 is securely retained on the lace 40 by knot 48 to prevent loss. The knot 48 is not, however, otherwise used by fastener 10 to secure the ends 36 and 38 of the lace 40. The fastener 10 remains free to slidably move along the lace ends 36 and 38.

With the fastener 10 prepared for use in this manner, fastener 10 and lace 40 can cooperatively be used to secure the shoe 42 by very small children and individuals who have only one hand available or free for use. In that regard, the fastener 10 is first moved down the ends 36 and 38 of the lace until it is firmly in contact with the shoe 42, as shown in FIG. 3. As will be appreciated, the ends 36 and 38 of lace 40 slide freely within the passages 28 and 30 of openings 20 and 22 as the fastener 10 is moved to this position.

With the fastener 10 positioned firmly against the shoe 42, the fastener 10 is then flipped upside down, or roughly 180 degrees about the axis defined by openings 20 and 22 and recesses 24 and 26. At this point, the first surface 14, which was previously facing down, is now facing up. The rotation of the fastener 10 in this manner draws the ends 36 and 38 of the lace 40 extending from shoe 42 radially outward into the slots 32 and 34, as shown in FIGS. 4 and 5.

With slots 32 and 34 dimensioned in the manner previously described, slots 32 and 34 securely grasp the ends 36 and 38 of the lace. As a result, the ends of the lace 40 are "fastened" together, preventing the flaps of the shoe 42 from spreading and the shoe 42 from loosening on a wearer's foot. The recesses 24 and 26 further assist slots 32 and 34 by engaging a portion of the ends 36 and 38 of the lace 40 passing over the perimeter 18 of body 12, reducing the likelihood of the ends 36 and 38 slipping with respect to perimeter 18 and allowing the lace 40 to loosen. Finally, the aglets 44 and 46 of the lace 40 are tucked into the shoe as shown in FIG. 4 to prevent the wearer from tipping.

To "untie" the lace 40 on shoe 42, the preceding process is simply reversed. In that regard, the fastener 10 is again flipped over so that the second surface 16 is facing upward. The lace fastener 10 is then drawn upward toward knot 48, allowing the flaps of the shoe 42 to spread and the shoe 42 to be easily removed. The knot 48, however, retains the fastener 10 in place for the next time the lace 40 is to be fastened.

The fastener 10 constructed in the preceding manner has a number of advantages. In that regard, the fastener 10 is extremely simple and inexpensive to manufacture. Further, the fastener 10 is simple and easy to use, allowing an individual of extremely limited capability to quickly and effectively securely tie a lace on an article of clothing.

Addressing now several alternative constructions, a second embodiment 50 of the lace fastener is shown in FIG. 5. In that regard, fastener 50 is largely identical to fastener 10, except that the first surface 14 is provided with a dome 52 and lace channels 54 and 56. The dome 52 may be roughly 0.32 centimeter and generally defines a section of a spherical surface intersecting with the perimeter 18 of the fastener 50. The channels 54 and 56 extend from the slotted openings 20 and 22 to the perimeter 18 and have lower surfaces 58 and 60 that run roughly parallel to the second surface 16 of fastener 50. The remaining features of fastener 50 are the same as those of fastener 10.

As will be appreciated, fastener 50 works in substantially the same manner as fastener 10. In this embodiment, however, the recesses 24 and 26 are replaced by the more substantial channels 54 and 56 to increase the retention of the lace ends 36 and 38. As a result, fastener 50, though slightly more complicated, is expected to provide better fastening characteristics.

Figure 7:
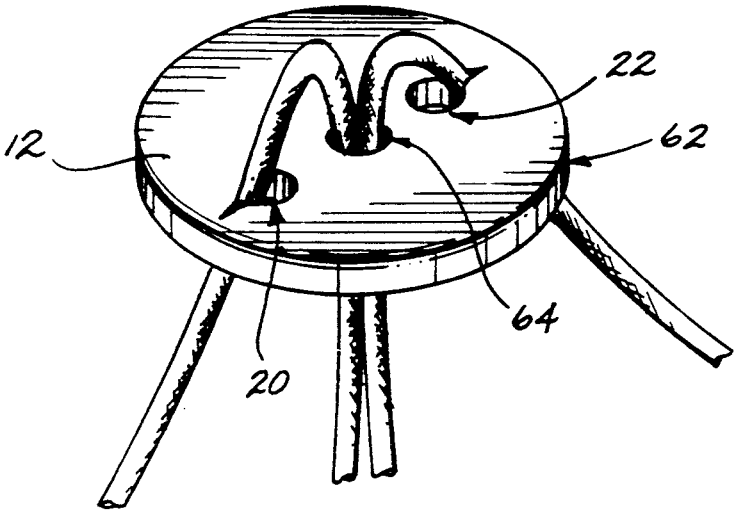
FIG. 7 is an illustration of a second alternative embodiment of the lace fastener of FIG. 1.

Addressing now a second alternative embodiment 62 of the fastener, reference is had to FIG. 7. This embodiment also parallels the fastener 10 described in connection with FIG. 1. In this embodiment, however, openings 20 and 22 are spaced farther apart about a centrally located opening 64. The remaining features of fastener 62 are the same as fastener 10.

The central opening 64 of fastener 62, which is substantially cylindrical and 0.64 centimeter in diameter, is intended to receive both ends 36 and 38 of a lace 40. The ends are then further passed through slotted openings 20 and 22 before being tied in a knot as described above in connection with FIG. 2. Fastener 62 is then used by simply sliding it down the laces and pulling on the knotted ends of the laces to draw them into the slots 32 and 34 and secure the shoe in place.

Figure 8:
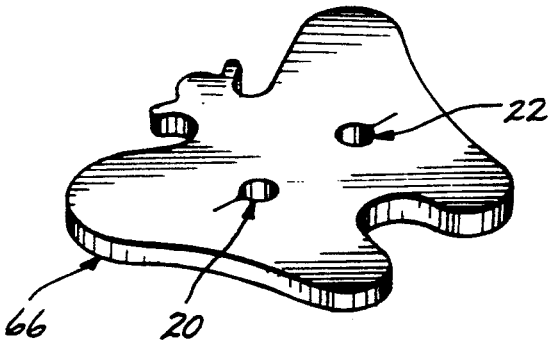
FIG. 8 is an illustration of a third alternative embodiment of the lace fastener of FIG. 1.

Finally, a third alternative embodiment 66 of fastener 10 is shown in FIG. 8. This embodiment parallels lace fastener 10 with the exception that a more attractive shape, such as that of a butterfly, is employed. As will be appreciated, a variety of other shapes could be employed.

Each of the embodiments of the fastener 10 described above makes fastening of a lace 40 simple, easy, quick, and effective. This is especially true for individuals that are quite young or have only one hand free or available to perform the fastening. Further, the various embodiments of fastener 10 are simple and inexpensive to construct.

Those skilled in the art will recognize that the embodiments of the invention disclosed herein are exemplary in nature and that various changes can be made therein without departing from the scope and the spirit of the invention. In this regard, and as was previously mentioned, the invention is readily embodied with various slot constructions, groove constructions, and shapes. Further, it will be recognized that the material and relative dimensions of the fastener can be varied as desired. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. A lace fastener, for securing the ends of a lace, comprising:

a main body having a first surface, a second surface, and a perimeter, said main body provided with a pair of slots extending between said first and second surfaces for slidably engaging the ends of the lace and for securing the ends together, said main body further being provided with a pair of recesses, extending into said first surface and said perimeter, for further engaging the ends of the lace.

2. The lace fastener of claim 1, wherein said body is made of a resilient material.

3. The lace fastener of claim 1, wherein said first surface is domed and provided with a pair of grooves for frictionally engaging the lace.

4. A method of tying the ends of a lace attached to an article of clothing comprising the steps of:

engaging each end of the lace with a slot provided in a fastening device, wherein said step of engaging comprises the step of threading each end of the lace through a separate opening, having a slot, in a roughly plate-like fastening device;

moving the fastening device adjacent the article of clothing, wherein said step of moving comprises the step of sliding the fastening device along each end of the lace until it is adjacent the article of clothing; and rotating the fastening dévice to produce a secure frictional engagement between the ends of the lace, the fastening device, and the article of clothing, wherein said step of rotating comprises the step of rotating the fastening device roughly 180 degrees about an axis extending through the separate openings in the fastening device.

* * * * *